US005259534A

United States Patent [19]

Lynd

[11] Patent Number: 5,259,534

[45] Date of Patent: Nov. 9, 1993

[54] CONTAINER CAP WITH REMOVABLE INSERT

[75] Inventor: Larry G. Lynd, Canal Winchester, Ohio

[73] Assignee: National Packaging, Columbus, Ohio

[21] Appl. No.: 936,662

[22] Filed: Aug. 28, 1992

[51] Int. Cl.[5] ..... B67D 5/00

[52] U.S. Cl. ..... 222/81; 222/185; 141/346; 141/364

[58] Field of Search ..... 222/146.6, 83.5, 185, 222/81; 141/346, 349, 351, 286, 364; 62/389

[56] References Cited

U.S. PATENT DOCUMENTS 5,031,676 7/1991 Ulm ..... 222/146.6 X 5,121,778 7/1992 Baker et al. ..... 222/146.6 X

*Primary Examiner*—Gregory L. Huson

*Attorney, Agent, or Firm*—Biebel & French

[57] ABSTRACT

A cap for a liquid container is provided with the cap having a sidewall, an upper surface, an aperture sidewall, and an insert. The aperture sidewall includes an interior surface and a bottom. the insert has a sidewall portion and a bottom portion. The insert is adapted to be displaceable axially along the interior surface of the aperture sidewall in a first and a second direction. It is adapted when displaced axially in the first direction to cooperatively engage with the aperture sidewall so as to form a fluid-tight seal. The insert is adapted when displaced axially in the second direction to permit the passage of liquid through the aperture. The cap is adapted to be retained in fluid-tight sealing relationship with a liquid container by a screw-thread.

18 Claims, 3 Drawing Sheets

CONTAINER CAP WITH REMOVABLE INSERT

BACKGROUND OF THE INVENTION

This invention is directed to the providing of a plastic cap for use with liquid dispensing systems and the like, and more particularly to such a cap that includes means for dispensing liquid through a cap without the necessity of removing the cap from the liquid dispensing system.

Increasing numbers of individuals have found it desirable to consume bottled water. This is relatively simple at home and in restaurants where individual bottles of water may be utilized to effect drinking. However, this is relatively costly. At the industrial level, large water coolers containing bottled water are often utilized, and are more cost-effective. In fact, some homes use the larger dispensing systems. These liquid dispensing systems often utilize bottles which contain several gallons of water.

One major drawback associated with the use of current liquid dispensing systems concerns the spillage of water which may occur when a relatively empty bottle needs to be replaced. When an empty bottle is removed from typical liquid dispensing systems, the bottle must be lifted away from the dispensing system and inverted to prevent the discharge of water through the neck of the bottle.

The spillage on the floor of water, or of any other liquid contained in the bottle, can create an safety hazard. Additionally, the wasted water incurs an economic liability. Still further, the leaked water on a carpeted floor, or a tile or concrete floor covered with a thin layer of dirt, can create an unaesthetically pleasing living or work environment. Thus, there are a number of reasons why it is desirable to minimize the potential for the spillage of water from a liquid container of the type used in containerized liquid dispensing systems.

One attempt at coping with the aforementioned problem of spillage is shown in U.S. Pat. No. Re. 32,354, a reissue of U.S. Pat. No. 4,375,864, for a container for holding and dispensing fluid. This patent discloses a flexible bag to which a spout is connected. A specially designed adapter within the spout has an opening sealed by a plug member. A tubular probe is inserted into the adapter opening and snapped onto the plug. The connected probe and plug are then pressed into the bag to permit fluid to flow through apertures in the probe. Withdrawing the probe from the bag snaps the plug back into the adapter to purportedly reseal the bag without substantial introduction of air and without any leakage.

Another attempt at coping with the aforesaid problem is disclosed in U.S. Pat. No. 4,699,198 for a hygienic liquid dispensing system. This particular liquid dispensing system includes a liquid container, a hygienic cap, and a liquid dispenser. A sharpened feed tube located within the dispenser pierces the cap when the container is lowered to its dispensing position. Unfortunately, some of the systems, such as U.S. Pat. No. 4,699,198 are not completely resealable, therefore permitting the possibility of leakage. Other systems are relatively complex and expensive.

Still further, systems like those discussed above utilize caps which are secured to the bottles much as metal caps were secured to soda-pop bottles decades ago, by a crimping of the sidewall of the cap about the rounded lip of the bottle so as to spring-seal the bottle. However, the modern bottled water systems have replaced the metal caps with plastic ones. The plastic cap is molded so that the interior surface of its sidewall fits snugly against the outer surface of the bottle, especially in the region of the bottle's lip, as the plastic cap "snaps" on to the bottle.

One result of this replacement is the tendency for the plastic caps to not form as tight a seal as the spring-sealed metal caps. Consequently, there is always the possiblity that the existing caps may leak, even before the container is "opened." The fact that these caps are prone to leakage presents problems in the storage, transportation, and usage of bottled water containers equipped with this type of cap.

It is thus apparent that the need exists for an improved cap for a liquid container of the type used in liquid dispensing systems.

SUMMARY OF THE INVENTION

The problems associated with prior liquid dispensing systems and their container caps are overcome in accordance with the present invention by the providing of a cap comprising a sidewall, an upper surface, an aperture sidewall, and an insert. The upper surface has formed therein an aperture such that the aperture sidewall intersects the upper surface adjacent the aperture. The aperture sidewall comprises an interior surface as well as a bottom. The insert comprises a sidewall portion and a bottom portion, with the sidewall portion positioned centrally adjacent the aperture sidewall.

The insert is adapted to be displaceable axially along the interior surface in a first and a second direction. The insert is also adapted when displaced axially in the first direction to cooperatively engage with the aperture sidewall so as to form a fluid-tight seal. The insert is also adapted when displaced axially in the first direction to a first position to be restrained from further movement in the first direction. Furthermore, the insert when displaced axially in the second direction is adapted to permit the passage of liquid through the aperture.

More preferably the sidewall has an inner and an outer surface, with the inner surface comprising a screw-thread. Additionally, preferably the insert is adapted to be slidably displaceable along the interior surface.

Preferably the interior surface has formed thereon a detent and the sidewall portion has formed therein a recessed portion such that the detent and recessed portion cooperate to form the fluid-tight seal. Preferably the detent is formed adjacent the bottom of the aperture sidewall. Additionally, the insert is adapted when displaced axially in the second direction to become completely detached from the aperture sidewall.

Preferably the insert sidewall portion is adapted to cooperatively engage with a liquid dispenser. Furthermore, the insert sidewall preferably has an interior insert surface with an insert detent formed thereon. The sidewall portion of the insert has a flange projecting outwardly therefrom. The insert is adapted when displaced axially in the first direction to be restrained by the flange from further movement in the first direction. Furthermore, the insert when displaced axially in the second direction is displaced into the liquid container with the insert remaining cooperatively engaged with a liquid dispenser.

There is also disclosed a cap for a liquid container comprising a sidewall, an upper surface, an aperture sidewall and an insert. The upper surface has formed therein an aperture and the aperture sidewall intersects the upper surface adjacent the aperture. The aperture sidewall comprises an interior surface as well as a bottom. The insert comprises a sidewall portion and a bottom portion. The sidewall portion is positioned centrally adjacent the aperture sidewall. The insert sidewall has an interior insert surface with an insert detent formed thereon. The insert sidewall portion is adapted to cooperatively engage with a liquid dispenser. The insert is adapted to be displaceable axially along the interior surface in a first and a second direction. The interior surface has formed thereon a detent, and the sidewall portion has formed therein a recessed portion, with the detent and recessed portion cooperating to form a fluid-tight seal when the insert is displaced axially in the first direction to cooperatively engage the detent and the recessed portion.

The insert is further adapted when displaced axially in the first direction to a first position to be restrained from further movement in the first direction. Moreover, the insert, when displaced axially in the second direction is adapted to become completely detached from the aperture sidewall thereby permitting the passage of liquid through the aperture.

Preferably the sidewall has an inner and an outer surface with the inner surface comprising a screw-thread. Additionally, the insert is adapted to be slidably displaceable along the interior surface of the aperture sidewall. Additionally, the sidewall portion of the insert has a flange projecting outwardly therefrom. The detent is preferably formed adjacent the bottom of the aperture sidewall. The insert is adapted when displaced axially in the first direction to be restrained by the flange from further movement in the first direction. The insert when displaced axially in the second direction is displaced into the liquid container with the insert remaining cooperatively engaged with the liquid dispenser.

There is also disclosed a cap for a liquid container with the cap comprising a sidewall, an upper surface, an aperture sidewall, and an insert. The upper surface has formed therein an aperture. The aperture sidewall intersects the upper surface adjacent the aperture. The aperture sidewall comprises an interior surface and a bottom.

The insert comprises a sidewall portion and a bottom portion. The sidewall portion is positioned centrally adjacent the aperture sidewall. The insert sidewall portion has means for cooperatively engaging with a liquid dispenser. The insert is adapted to be displaceable axially along the interior surface of the aperture sidewall in a first and a second direction. Additionally, the interior surface and the sidewall portion respectively have means for cooperatively engaging the interior surface and the sidewall portion. The means for engaging the interior surface and the sidewall portion cooperate to form a fluid-tight seal with the insert is displaced axially in the first direction. Furthermore, the insert is adapted when displaced axially in the first direction to a first position to be restrained from further movement in the first direction. Still further, the insert when displaced axially in the second direction is adapted to permit the passage of liquid through the aperture.

It is the primary object of the present invention to provide a cap which can be utilized with liquid dispensing systems, and is conveniently and inexpensively formed, yet which provides a cap capable of permitting the passage of liquid therethrough while at the same time possesses the capability of being able to be resealed.

Another objective of the present invention is to provide a cap for use with existing sized water bottles or other liquid containers.

Another objective of the present invention is to provide cap which permits for passage of a liquid therethrough while at the same time providing a cap with improved sealing capabilities.

Other objects and advantages of the invention will be apparent from the following description, the accompanying drawings, and the appended claims.

DETAILED DESCRIPTION OF THE INVENTION

Figure 1:
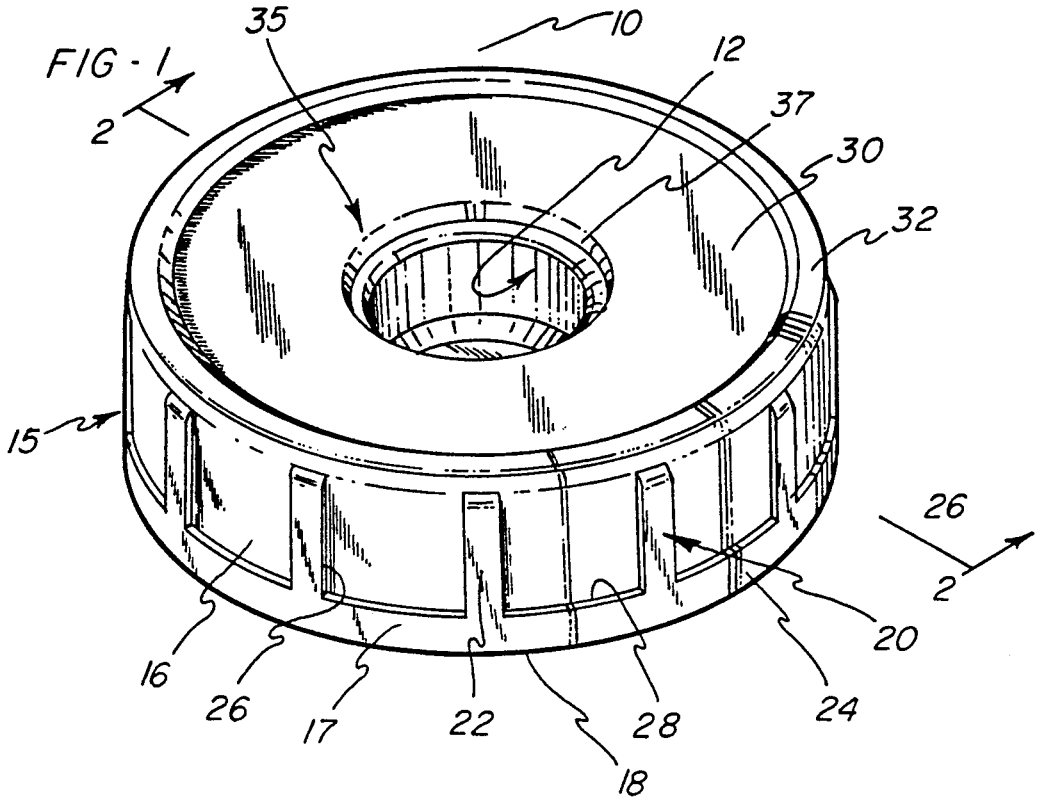
FIG. 1 is a perspective view of a cap made in accordance with the present invention.

Having reference to the drawing figures, attention is directed first to FIG. 1 which discloses a perspective view of the cap made in accordance with the present invention, with the cap designated generally by the numeral 10. The cap comprises an insert 12, a sidewall 15, and an upper surface 30. The sidewall portion of the cap 10 comprises a sidewall inner surface and a sidewall outer surface 16 having a lip 17 formed preferably adjacent the cap bottom 18. This lip preferably extends around the entire circumference of the sidewall 15.

Also formed as part of sidewall 15 are a plurality of vertically extending ribs 20. The ribs 20 have a rib face 22 spaced apart from the sidewall outer surface 16 approximately the same distance as is the outer sidewall of the lip 24. The ribs 20 preferably have a pair of rib sidewalls 26 which connect the majority of the rib face 22 with the sidewall outer surface 16. A lip upper surface 28 is formed along the top of the lip 17. This lip upper surface 28 spans between those rib sidewalls 26 which face one another.

The cap upper surface 30 is separated from the sidewall 15 by a rounded shoulder portion 32, in this particular embodiment of the invention. Formed preferably at the center of the upper surface 30 is a cap aperture 35, with this cap aperture 35 having an aperture sidewall 37 formed so as to intersect the lower surface of the upper surface 30 adjacent the aperture 35. This aperture sidewall 37, which is preferably cylindrically shaped, is formed having an inner surface 38 and an exterior surface 39, as can best be seen in FIG. 2.

It will also be noted that the aperture sidewall 37 has formed thereon a cap detent 40 preferably adjacent the aperture sidewall bottom 41. This cap detent preferably is in the form of a ring which extends inwardly from the aperture sidewall inner surface 38.

Figure 2:
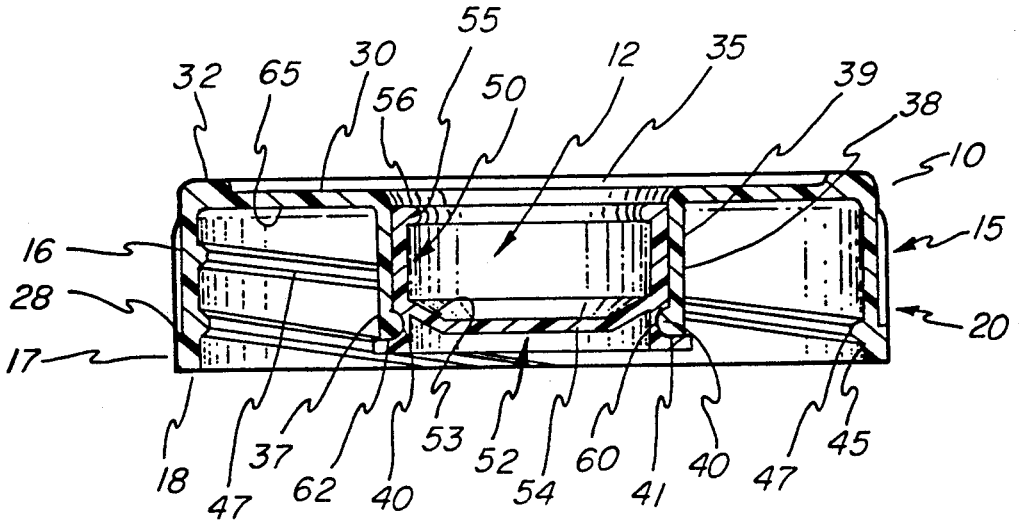
FIG. 2 is a vertical sectional view taken along 2—2 of FIG. 1.
Figure 4:
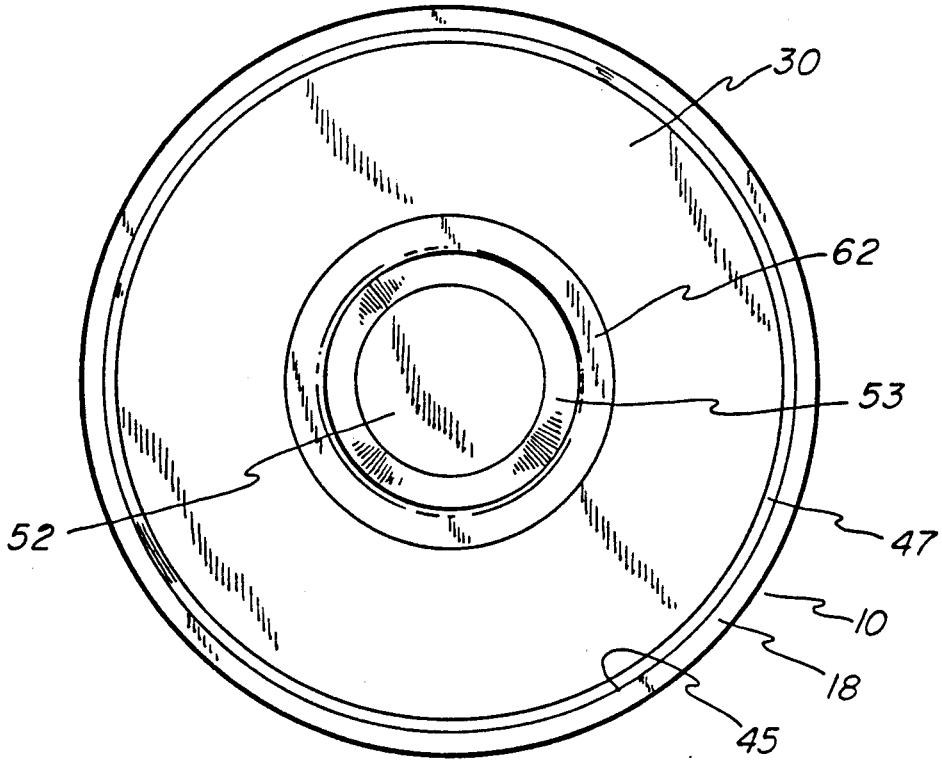
FIG. 4 is a bottom plan view.

The cap 10 also has a cap sidewall inner surface 45 as can be appreciated from a comparison of FIGS. 2 and 4. Formed as part of the sidewall is a screw-thread 47. Thus, the configuration of the sidewall inner surface 38 differs dramatically from the completely smooth sidewall inner surfaces associated with prior art caps for use with water dispensing systems.

Figure 3:
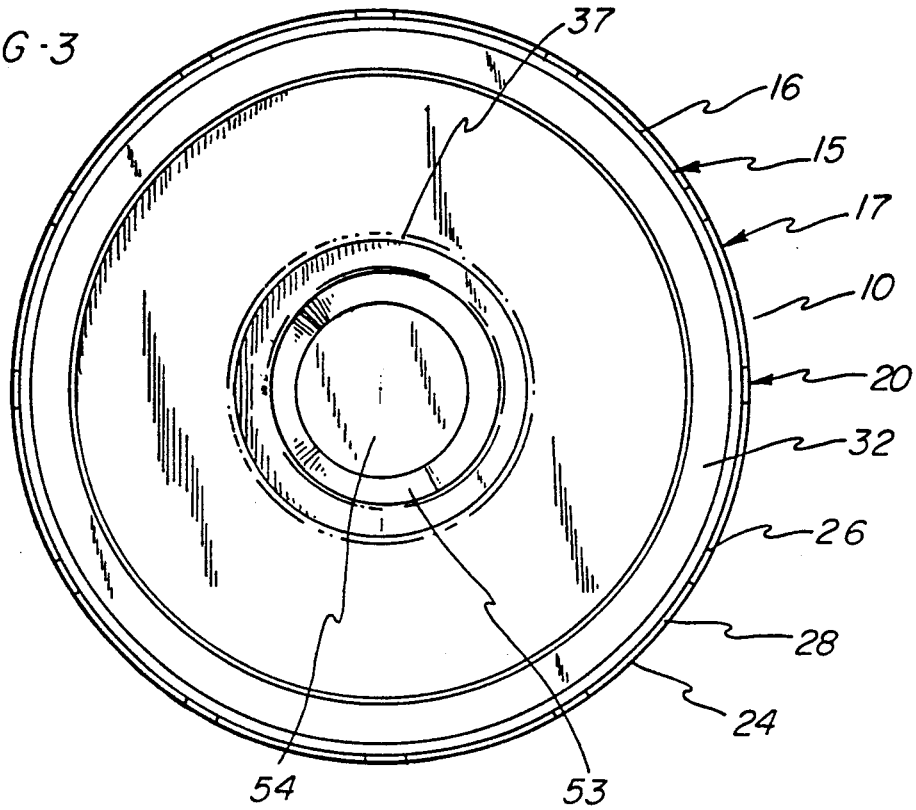
FIG. 3 is a top plan view.

The insert 12 preferably has an insert sidewall portion 50 and an insert bottom portion 52, as can be appreciated from a comparison of FIGS. 2, 3 and 4. The insert sidewall portion 50 is positioned centrally adjacent the aperture sidewall 37. The insert bottom portion in the preferred embodiment of the invention is formed having an inclined surface 53 which connects the insert sidewall portion 50 or interior insert surface with a bottom surface 54 of the insert bottom portion 52. The insert sidewall portion 50 preferably has an insert detent 55 formed thereon. Preferably this insert detent 55 is formed adjacent the top edge 56 of the insert sidewall portion 50. As is the case with the cap detent 40, the insert detent 55 is also preferably in the shape of a thin ring.

The insert sidewall portion 50 also has preferably formed therein a recessed portion 60 with this recessed portion preferably being located near the bottom of the insert sidewall portion 50 as to cooperatively engage with the cap detent 40 formed on the aperture sidewall 37 of cap 10. Also formed at the bottom of the insert sidewall portion 50 is an outwardly projecting flange 62. Preferably this outwardly projecting flange 62 is oriented perpendicularly to the insert sidewall portion 50 of the insert 12. The flange 62 preferably has its upper surface in contact with the bottom 41 of the aperture sidewall when insert 12 is oriented with respect to the aperture sidewall 37 such that preferably the cap detent 40 and recessed portion 60 serve as means for cooperatively engaging the interior side and the sidewall portion so as to form a fluid-tight seal.

Figure 5:
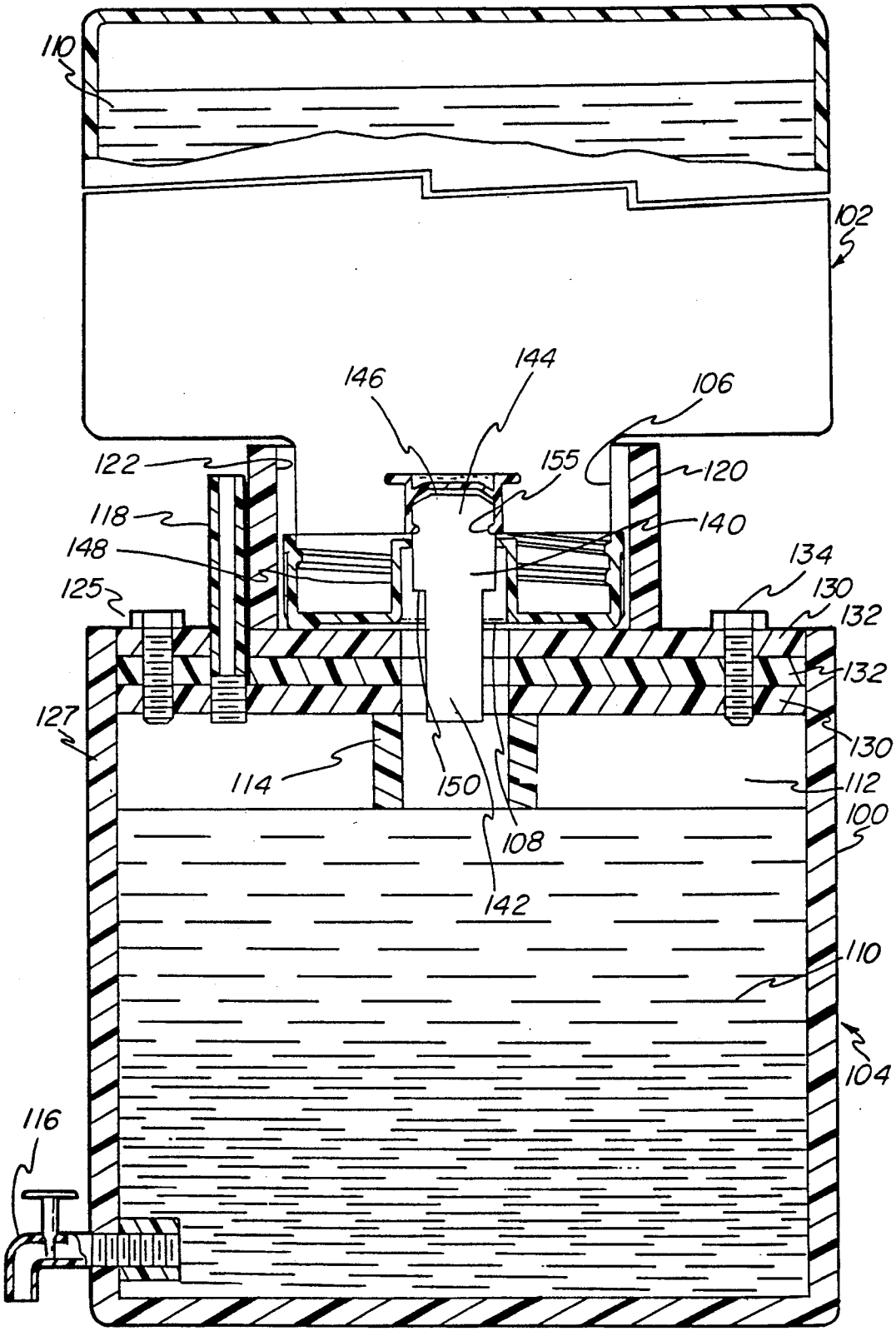
FIG. 5 is a partial cross-sectional view with a cut away, of a liquid dispensing system utilized in conjunction with the present invention disclosing the cap of this present invention in use.

The insert is adapted to be displaceable axially along the interior surface in a first as well as a second direction as can be appreciated from a comparison of FIGS. 2 and 5. Preferably the insert is slidably displaceable. When the insert is displaced axially in the first direction, the cap detent 40 and recessed portion 60 cooperatively engage with one another to form a fluid-tight seal with respect to the entire cap 10. Furthermore, when the insert is displaced in this first direction to a first position as shown in FIG. 2, further movement of the insert in the first direction is restrained by the interaction of the outwardly projecting flange 62 and the aperture sidewall bottom 41. When the insert is displaced axially in the second direction, the displacement permits the passage of liquid through the aperture. As discussed above with reference to the location of the aperture sidewall the cap 10 has a cap upper surface interior 65 as the lower surface of cap upper surface 30.

The cap 10 of this invention is believed to have significant possibilities for use with liquid dispensers 100 of the general type shown in FIG. 5. Such liquid dispensers 100 normally include a liquid container 102 and a dispensing unit 104. Typically the liquid containers 102 are referred to as water bottles and are of the type having a neck 106 and a container aperture 108 through which a liquid 110 flows from the liquid container 102 into chamber 112 of the dispensing unit 104.

Passage of the liquid 110 into the dispensing unit 104 is channeled by a fluid connector 114. Additionally, the dispensing unit 104 includes a valve 116 by which liquid can be removed from the dispensing unit 104 and an air conduit 118 which assists with the discharge of the liquid 110 from the dispensing unit 104 by allowing the introduction of air into the upper portion of the chamber 112.

To facilitate the mounting of the liquid container 102 onto the dispensing unit 104, a mounting receptacle 120 is provided. This mounting receptacle 120 is located on the upper surface of the dispensing unit and extends upwardly therefrom. It is preferably cylindrical and has an inner wall 122 which encompasses the neck 106 of the liquid container 102. The mounting receptacle 120 may be formed separately from or as an integral part of the cover 125 of the dispensing unit 104. The cover 125 is located at the top of the housing 127 of the dispensing unit. The cover is preferably fabricated from a plurality of plates 130 having a fluid-tight gasket 132 secured therebetween by bolts 134.

The dispensing unit 104 also comprises a plunger 140 with this particular element having a retention portion 142 as well as engaging portion 144. The retention portion 142 is attached to the cover 125. The engaging portion 144 has a top surface 146, a sidewall 148 and a bottom 150 which extend within the mounting receptacle 120 so as to come into contact with the insert 12 of cap 10.

The cap also has means for cooperatively engaging a liquid dispenser. As the engaging portion 144 slides into the insert 12, its sidewalls 148 are parallel and adjacent to the insert sidewall portion 50. The engaging portion continues to proceed until the insert detent 55 preferably cooperatively engages the recessed portion 155 of the engaging portion 144. As additional pressure is placed on the insert by the engaging portion, the insert preferably becomes slidably displaceable so as to effect the opening of the aperture in the cap 10 for passage of liquid 110 therethrough. Preferably the insert becomes completely detached from the cap while remaining cooperatively engaged with the engaging portion 144 of the liquid dispenser 100. Furthermore, as can be seen in FIG. 5, the insert by this time is effectively displaced into the liquid container 102.

When the liquid container 102 is removed from the mounting receptacle 120, the cap is slidably displaced with respect to the insert 12 until the cap detent 40 and recessed portion 60 cooperate to once again form a fluid-tight seal between the insert and the aperture sidewall 37. Eventually the flange 62 prevents further movement of the insert relative to the aperture sidewall.

Preferably the cap sidewall, cap aperture, and upper surface and insert are molded from a plastic material, preferably high density polyethylene or polypropylene. Preferably the diameter of the cap is approximately 2", with the height of the cap being approximately ½". Preferably the aperture formed in the upper surface of the cap is approximately ¾" wide and tapered slightly inwardly from the top to the bottom of the aperture sidewall. For example, the distance across the top of the aperture at the upper surface is preferably 0.754", while the distance across at the cap detent 40 is preferably 0.738". Additionally, as can be seen in the drawing figures, the length of the aperture sidewalls are less than that of the actual sidewall 15 of the cap. Preferably the thread finish associated with the cap is 48 mm, so as to form a fluid-tight seal with the liquid container 102.

With respect to the insert, the height of the insert sidewall portion 50 is approximately 0.430" with the distance across the insert at the insert detent being 0.644" while the remainder of the distance across the insert from insert sidewall to insert sidewall is 0.660". The flanges extend approximately 0.063" beyond the exterior portion of the insert sidewall. The bottom surface of the insert bottom portion is preferably 0.42" in diameter.

The cap for the liquid container made in accordance with the present invention provides for a cap which can be easily opened as well as resealed. An important aspect of the invention is the fact that the resealing permits the repositioning of the insert into the cap so as to form a fluid-tight seal. Furthermore, the utilization of a screw-threaded cap which provides an improved fluid seal in connection with a resealable cap represents a distinct improvement over the prior art. Additionally, the cap is extremely attractive and relatively easy to produce and assemble.

While the preferred form of apparatus herein described constitutes a preferred embodiment of the invention, it is to be understood that the invention is not limited to this precise form of apparatus, and that changes may be made therein without departing from the scope of the invention which is defined in the appended claims.

What is claimed is:

1. A cap for a liquid container, said cap comprising a sidewall, an upper surface, said upper surface having formed therein an aperture, and an aperture sidewall, said aperture sidewall intersecting said upper surface adjacent said aperture, said aperture sidewall comprising an interior surface and a bottom, and an insert, said insert comprising a sidewall portion and a bottom portion, said sidewall portion positioned centrally adjacent said aperture sidewall, said sidewall portion having a top edge with an inwardly extending detent located directly adjacent thereto and said sidewall portion having a bottom, said bottom portion of said insert comprising a bottom surface portion and an inclined surface portion, said inclined surface portion located between said bottom surface portion and said sidewall portion and extending downwardly from said sidewall portion intermediate said top edge and bottom of said sidewall portion to said bottom surface portion, said bottom surface portion being disposed above said bottom of said sidewall portion, said insert adapted to be displaceable axially along said interior surface in a first and a second direction, said insert adapted when displaced axially in said first direction to cooperatively engage with said aperture sidewall so as to form a fluid-tight seal, said insert adapted when displaced axially in said first direction to a first position to be restrained from further movement in said first direction, said insert when displaced axially in said second direction adapted to permit the passage of liquid through said aperture.

2. The cap according to claim 1 wherein said sidewall has an inner and an outer surface, said inner surface comprising a screw-thread.

3. The cap according to claim 1 wherein said insert is adapted to be slidably displaceable along said interior surface.

4. The cap according to claim 3 wherein said interior surface has formed thereon a detent and said sidewall portion has formed therein a recessed portion, said detent and recessed portion cooperating to form said fluid-tight seal.

5. The cap according to claim 1 wherein said insert is adapted when displaced axially in said second direction to become completely detached from said aperture sidewall.

6. The cap according to claim 4 wherein said detent is formed adjacent said bottom.

7. The cap according to claim 1 wherein said insert sidewall portion is adapted to cooperatively engage with a liquid dispenser.

8. The cap according to claim 1 wherein said sidewall portion has a flange projecting outwardly therefrom.

9. The cap according to claim 8 wherein said insert is adapted when displaced axially in said first direction to be restrained by said flange from further movement in said first direction.

10. The cap according to claim 7 wherein said insert when displaced axially in said second direction is displaced into the liquid container, said insert remaining cooperatively engaged with a liquid dispenser.

11. A cap for a liquid container, said cap comprising a sidewall, an upper surface, said upper surface having formed therein an aperture, and an aperture sidewall, said aperture sidewall intersecting said upper surface adjacent said aperture, said aperture sidewall comprising an interior surface and a bottom, and an insert, said insert comprising a sidewall portion and a bottom portion, said sidewall portion positioned centrally adjacent said aperture sidewall, said sidewall portion having a top edge with an inwardly extending detent located directly adjacent thereto and said sidewall portion having a bottom, said bottom portion of said insert comprising a bottom surface portion and an inclined surface portion, said inclined surface portion located between said bottom surface portion and said sidewall portion and extending downwardly from said sidewall portion intermediate said top edge and bottom of said sidewall portion to said bottom surface portion, said bottom surface portion being disposed above said bottom of said sidewall portion, said insert sidewall portion adapted to cooperatively engage with a liquid dispenser, said insert adapted to be displaceable axially along said interior surface in a first and a second direction, said interior surface having formed thereon a detent and said sidewall portion having formed therein a recessed portion, said detent and recessed portion cooperating to form a fluid-tight seal when said insert is displaced axially in said first direction to cooperatively engage said detent and said recessed portion, said insert adapted when displaced axially in said first direction to a first position to be restrained from further movement in said first direction, said insert when displaced axially in said second direction adapted to become completely detached from said aperture sidewall thereby permitting the passage of liquid through said aperture.

12. The cap according to claim 11 wherein said sidewall has an inner and an outer surface, said inner surface comprising a screw-thread.

13. The cap according to claim 11 wherein said insert is adapted to be slidably displaceable along said interior surface.

14. The cap according to claim 11 wherein said detent is formed adjacent said bottom.

15. The cap according to claim 11 wherein said sidewall portion has a flange projecting outwardly therefrom.

16. The cap according to claim 15 wherein said insert is adapted when displaced axially in said first direction to be restrained by said flange from further movement in said first direction.

17. The cap according to claim 11 wherein said insert when displaced axially in said second direction is displaced into the liquid container, said insert remaining cooperatively engaged with a liquid dispenser.

18. A cap for a liquid container, said cap comprising a sidewall, an upper surface, said upper surface having formed therein an aperture, and an aperture sidewall, said aperture sidewall intersecting said upper surface adjacent said aperture, said aperture sidewall comprising an interior surface and a bottom, and an insert, said insert comprising a sidewall portion and a bottom portion, said sidewall portion positioned centrally adjacent said aperture sidewall, said sidewall portion having a top edge and said sidewall portion having a bottom, said bottom portion of said insert comprising a bottom surface portion and an inclined surface portion, said inclined surface portion located between said bottom surface portion and said sidewall portion and extending downwardly from said sidewall portion intermediate said top edge and bottom of said sidewall portion to said bottom surface portion, said bottom surface portion being disposed above said bottom of said sidewall portion, said insert sidewall portion having means for cooperatively engaging with a liquid dispenser, said insert adapted to be displaceable axially along said interior surface in a first and a second direction, said interior surface and said sidewall portion respectively having means for cooperatively engaging said interior surface and said sidewall portion, said means for cooperatively engaging said interior surface and said sidewall portion cooperating to form a fluid-tight seal when said insert is displaced axially in said first direction, said insert adapted when displaced axially in said first direction to a first position to be restrained from further movement in said first direction, said insert when displaced axially in said second direction adapted to permit the passage of liquid through said aperture.

* * * * *